US005247755A

United States Patent [19]

Sato et al.

[11] Patent Number: 5,247,755

[45] Date of Patent: Sep. 28, 1993

[54] AUTOMATIC PAGE TURNING-OVER APPARATUS

[75] Inventors: Tadashi Sato, Tokyo; Noboru Koumura, Narashino, both of Japan

[73] Assignee: Canon Kabushiki Kaisha, Tokyo, Japan

[21] Appl. No.: 641,628

[22] Filed: Jan. 16, 1991

Related U.S. Application Data

[63] Continuation of Ser. No. 178,305, Apr. 6, 1988, abandoned.

[30] Foreign Application Priority Data

| | | | |
|---|---|---|---|
| Apr. 8, 1987 | [JP] | Japan | 62-086690 |
| Apr. 8, 1987 | [JP] | Japan | 62-086691 |
| Apr. 8, 1987 | [JP] | Japan | 62-086692 |
| May 22, 1987 | [JP] | Japan | 62-125473 |
| Jun. 6, 1987 | [JP] | Japan | 62-141864 |
| Jun. 16, 1987 | [JP] | Japan | 62-149838 |

[51] Int. Cl.[5] ..... G09F 11/00

[52] U.S. Cl. ..... 40/476; 40/531

[58] Field of Search ..... 40/531, 476, 570, 470, 40/156, 530, 475; 84/487, 502, 517

[56] References Cited

U.S. PATENT DOCUMENTS

| | | | |
|---|---|---|---|
| 3,800,453 | 4/1974 | Kroes | 40/531 |
| 4,031,644 | 6/1977 | Rogers | 40/531 X |
| 4,677,778 | 7/1987 | Sorimachi et al. | 40/476 |
| 4,719,712 | 1/1988 | Moreau et al. | 40/470 |

FOREIGN PATENT DOCUMENTS

| | | | |
|---|---|---|---|
| 2452383 | 11/1980 | France | 40/531 |
| 361906 | 2/1973 | U.S.S.R. | 40/531 |

*Primary Examiner*—Kenneth J. Dorner
*Assistant Examiner*—Milton Nelson, Jr.
*Attorney, Agent, or Firm*—Fitzpatrick, Cella, Harper & Scinto

[57] ABSTRACT

An automatic page turning-over apparatus has spacing means for spacing an uppermost sheet original of a book-like original having a bundle of bound sheet originals apart from the remainder of the bundle of sheet originals, wherein, a moving member moves under the uppermost sheet original and turns the uppermost sheet original onto the opposite side of the book-like original. A support means for supporting the spacing means and the moving member, while moving means moves the support means to move the spacing means and the moving member and thereby turn the page.

13 Claims, 13 Drawing Sheets

AUTOMATIC PAGE TURNING-OVER APPARATUS

This application is a continuation of application Ser. No. 07/178,305 filed Apr. 6, 1988, abandoned.

BACKGROUND OF THE INVENTION

1. Field of the Invention

This invention relates to an automatic page turning-over apparatus for automatically turning over the pages of a book or a plurality of sheets bound like a book by a binder or the like (hereinafter simply referred to as a "book").

The automatic page turning-over apparatus is used, for example, when a number of originals bound like a book are photographed or copied by a flat type camera or a copying apparatus, or when a physically handicapped person reads a book.

2. Related Background Art

Apparatus for automatically turning over the pages of a book are described in Japanese Laid-Open Patent Application No. 60294/1981 and Japanese Laid-Open Patent Application No. 119125/1981.

The apparatus described in Japanese Laid-Open Patent Application No. 60294/1981 is such that a conveying force toward the bound portion of a book is imparted by a roller to a sheet to be turned over to thereby form a loop. A wind is then applied to the loop or a bar-like member is inserted under the loop and the member is pivoted about the bound portion to thereby accomplish page turn-over. However, when a loop is to be made by a roller, it is necessary to stop the roller immediately after a loop of the first sheet has been formed, and control thereof has been difficult. Also, this apparatus requires a duct for the wind blast to be disposed and requires means for moving the bar-like member back and forth under the loop. This has led to the disadvantage that the entire apparatus becomes bulky.

The apparatus described in Japanese Laid-Open Patent Application No. 119125/1981 is such that a sheet to be turned over is held on a member by electrostatic attraction and the member is moved to thereby accomplish page turn-over. In such an apparatus, however, the member to which a voltage is applied must be moved while being insulated and the therefore, the structure for insulation becomes complex.

Also, when an opened book is placed on a flat bed, as in the above-described example of the prior art, the heights of the left and right uppermost sheets differ from each other except for when the thicknesses of the left and right groups of sheets with the bound portion of the book as the boundary are the same. If, in such a state, an attempt is made to photograph the spread left and right pages, the camera will be out of focus and blurred images will be formed.

Also, in the above-described example of the prior art, the direction in which pages are turned over has been limited to one direction and it has been impossible to turn over pages in the opposite direction.

SUMMARY OF THE INVENTION

The present invention has been made from the above-noted viewpoint and an object thereof is to provide, in view of the existing circumstances as described above, an automatic page turning-over apparatus in which the structure of a turning-over mechanism is compact and simple to handle.

Another object of the present invention is to provide an automatic page turning-over apparatus in which, in order to realize the structural simplification of said turning-over mechanism so as to make it suitable for the automatic page turning-over apparatus which is compact and simple to handle, the height levels of the spread left and right groups of sheets of a book are on one plane. The turning-over mechanism used for turning over pages is constructed as a scanning body which effects simple horizontal movement on the book.

It is also an object of the present invention to provide an automatic page turning-over apparatus which can turn over pages of a book both from right and from left, can be used without being restricted by the size and thickness of the book and the quality of paper of the book.

BRIEF DESCRIPTION OF THE DRAWINGS

FIG. 2 shows a fourth embodiment of the present invention.

DESCRIPTION OF THE PREFERRED EMBODIMENTS

Figure 1:
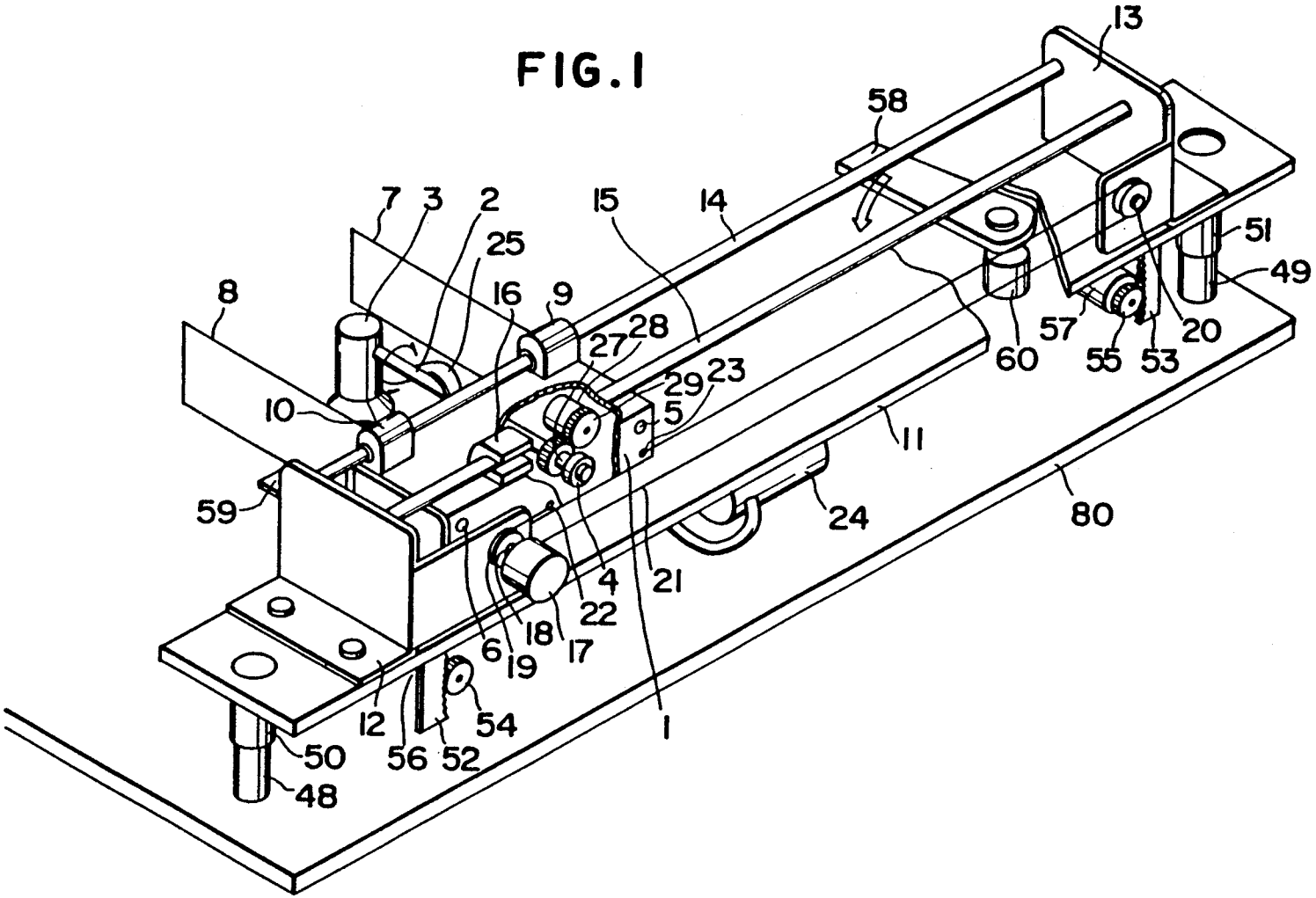
FIG. 1 is a perspective view showing an embodiment of the present invention.

The present invention will hereinafter be described with respect to some embodiments shown in the drawings.

FIG. 1 schematically shows an embodiment of the present invention.

In this figure, the reference numeral 1 designates a moving body adapted to move (scan) and effect the turning-over of pages and supported for movement (scanning) along parallel movement rail 14 and auxiliary rail 15. The reference numerals 9 and 10 denote rail bearings provided on the moving body 1 and fitted to the movement rail 14 mounted between a pair of rail receiving plates 12 and 13 spaced apart on a moving base plate 11 so as to enable said movement to be accomplished. The moving base plate 11 is provided on a fixed bed (bottom plate) 80 supporting the entire apparatus so as to make the whole turning-over mechanism, including the moving body 1, vertically movable while supporting the moving body 1. The reference numeral 16 designates an auxiliary rail receiver engaged with the auxiliary rail 15 to prevent rotation of the moving body 1 about movement rail 14.

A rotary shaft 2 protrudes from the moving body 1 in a direction orthogonal thereto in a horizontal plane. Movement is provided for rotation about the axis of the rotary shaft 2 extending in the direction of protrusion (rotation in the direction indicated by an arrow in FIG. 1). An absorbing body 3 having an absorbing surface at the lower end thereof is assembled to the end of the rotary shaft 2 in such a manner as to form a vertical posture. The reference numeral 4 designates a bearing for supporting the rotation of the rotary shaft 2 about the axis thereof.

The reference numerals 7 and 8 denote a pair of opposed paper applying plates fixedly supported in a vertical posture by a pair of paper applying shafts 5 and 6 protruded from the moving body 1, parallel to the rotary shaft 2, and in a predetermined spaced apart relationship with the rotary shaft 2 interposed therebetween. Thus, the pair of paper applying plates 7 and 8 hear against a sheet turned over by rotation of the absorbing body 3. It is preferable that the lower ends of the paper applying plates 7 and 8 be spaced apart somewhat in the upward direction (e.g. about 1 to 3 mm) from the absorbing body 3 to thereby prevent a book from being damaged when a page thereof is turned over.

The reference numeral 17 designates a motor fixedly provided on the rail receiving plate 12. The opposite ends of a wire 21, passed over a pulley 19 supported on the rotary shaft 18 of the motor 17 and a pulley 20 rotatably assembled to rail receiving plate 13 are connected to points 22 and 23 of the moving body 1. Movement (scanning) of the moving body 1 along the movement rail 14 may be accomplished at a velocity v by the rotation of the motor 17.

Reference numeral 24 denotes a compressor secured to the underside of moving base plate 11 and connected so as to be capable of supplying negative pressure, a vacuum to the absorbing body 3 through air pipe 25.

Figure 2A:
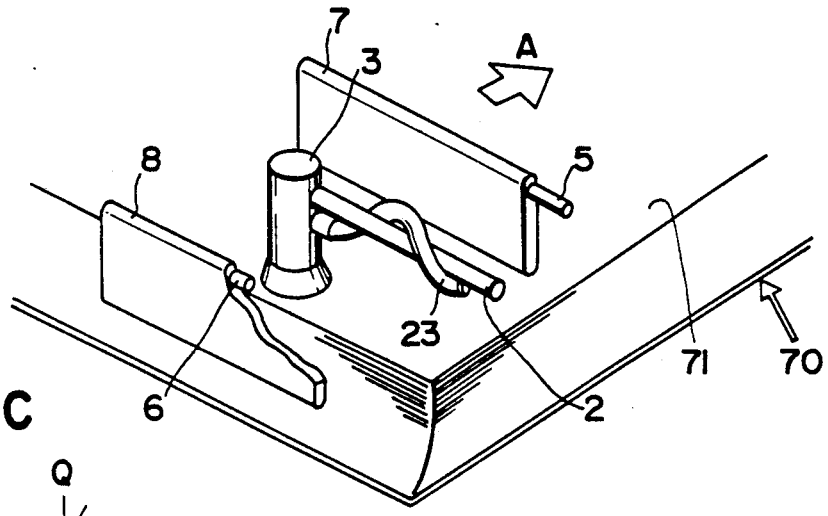
FIGS. 2A, 2B and 2C illustrate the operation of the present in invention.
Figure 2C:
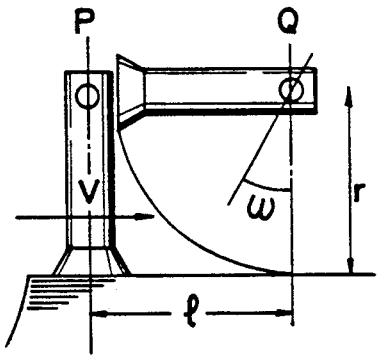
Figure 2B:
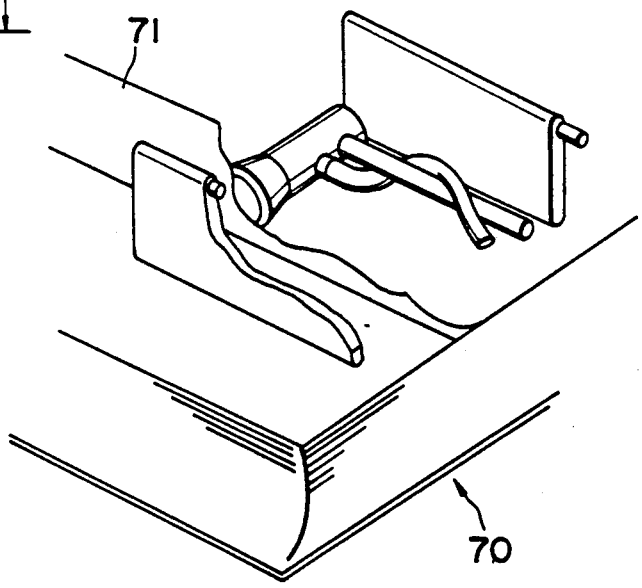

The general nature of the page turning-over mechanism of the automatic page turning-over apparatus according to the present embodiment has been described above, the details of the operation thereof will hereinafter be described with reference to FIGS. 2A, 2B, 2C, the block diagram of FIG. 3 and the flow chart of FIG. 4.

Figure 3:
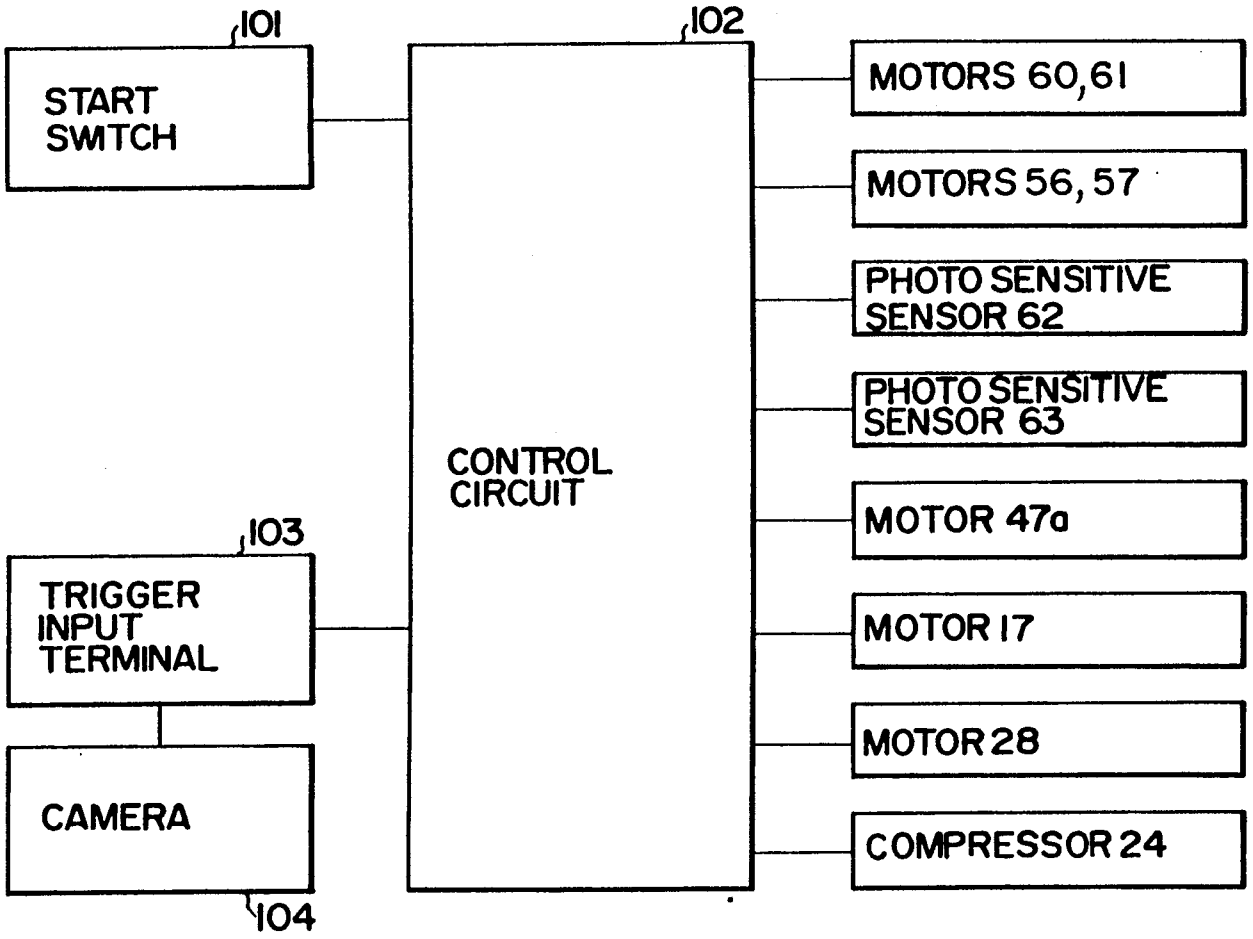
FIG. 3 is a block diagram.
Figure 4:
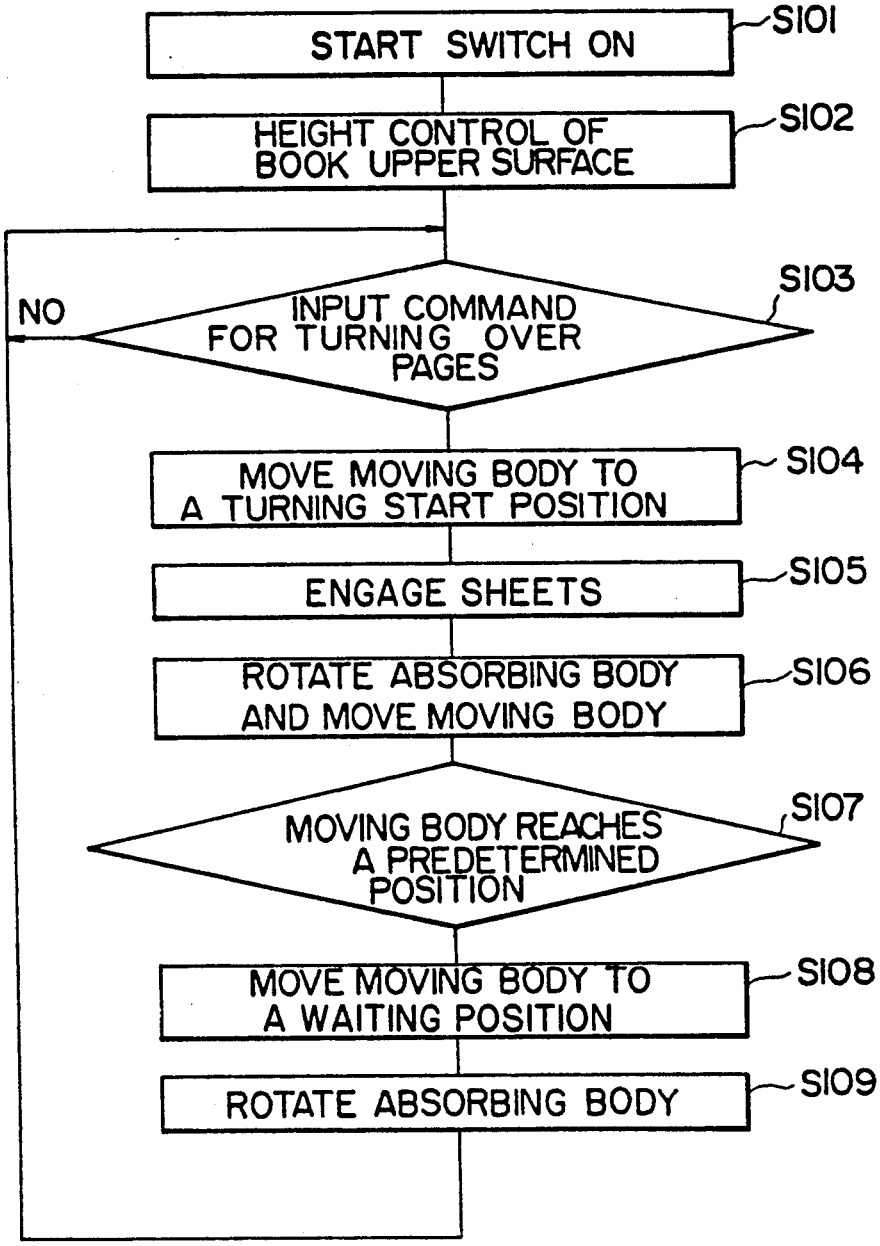
FIG. 4 is a flow chart.

In FIG. 3, the reference numeral 102 designates a control circuit for controlling the operation of the automatic page turning-over apparatus, and the reference numeral 101 denotes the start switch of the automatic page turning-over apparatus.

When a book is set at a predetermined position and the start switch 101 is depressed, the height control of the book is effected so that the upper surfaces of the left and right spread sheets of the book are at the same height, as will be described later (steps S101 and S102). The reference numeral 103 designates a trigger terminal for inputting a command signal to the control circuit for turning over pages. Where, for example, a camera is operatively associated with the page turning-over apparatus to photograph each page, the command signal for turning over pages may be a signal such as the film take-up command in the camera. Alternatively, the page turning-over apparatus may be connected to a mere switch so that the operator may operate this switch. When at step S103, it is judged that a page turning-over signal has been input, motor 17 is controlled at step S104 so that the moving 1, body which has so far stood by the book, is moved to the position of FIG. 2A (a turning start position) relative to the book.

Subsequently, negative pressure is supplied to the absorbing body 3 by the compressor 24 to cause the absorbing body 3 to engage with the uppermost page (step S105). Subsequently, at step S106, the motor 17 and the motor 28 are controlled by the control circuit 102 so that the absorbing body 3 engaged with the uppermost one of the left sheets of the book is rotated by about 90° and positioned between the paper applying plates 7 and 8 (see FIG. 2B). In synchronism therewith, the moving body 1 and the absorbing body 3 are moved onto the right group of sheets to effect movement for turning over the pages. In this case, the spacing between the paper applying plates 7 and 8 and the absorbing body 3 may preferably be set, for example, on the order of 3–10 mm.

In the present embodiment, the rotation of the rotary shaft 2 for rotating the absorbing body 3 is effected at an angular speed $\omega$ by causing the gear 29 mounted on the rotary shaft of the motor 28 rotated by the control circuit 102 to mesh with the gear 27 mounted on the portion of the rotary shaft 2 positioned in the moving body 1, as shown in FIG. 1.

At step S107, the moving body 1 (and accordingly the absorbing body 3) is moved to a predetermined position on the right group of sheets to thereby turn over a page, whereafter the motor 17 is rotated in the reverse direction to return the absorbing body 3 to its initial position (step S109). The absorbing body 3 may be caused to face downwardly by motor 28 to prepare for the turning-over of the next page, and then may be caused to wait (step S108).

The vacuum from the compressor 24 may be stopped when sheet 71, the uppermost page, bears against the paper applying plate 8.

The above-described page turning-over operation has been explained with respect to the operation from the left side to the right side, and is quite similar to the operation in the opposite direction.

Also, depending on the quality of the paper in the book, the necessary vacuum force of the absorbing body 3 differs, but this can be coped with if the pressure of the compressor is made controllable so as to be variable. For example, when the paper is thick, the pressure of the compressor may be increased, and when the paper is thin, the pressure of the compressor may be decreased.

In the automatic page turning-over apparatus of the present embodiment having the above-described construction and performing the above-described operation, the relationship between the rotation radius r of the absorbing body, the scanning speed v, and the rotational angular speed $\omega$ of the absorbing body is set to $v \geqq r\omega$ in order to prevent that problem, as described above. Too great a rotational angular speed $\omega$ of the absorbing body 3 would cause the absorbing body 3 to deviate from the pages of the book before the rotation of the rotary body 2 comes to the terminal position of the turning-over, whereby a reliable page turning-over operation cannot be ensured. More specifically, by setting the scanning distance r to 4 cm, the scanning speed v to 120 mm/sec., and the rotational angular speed m of the abosrbing body to 30°/sec., the above-mentioned condition is satisfied.

In the foregoing, the scanning distance r of the moving body strictly refers to the vertical spacing from the center of rotation of the rotary shaft 2 to the page being turned over, as already described.

Description will now be made of a mechanism for coping with any variation in the thickness of the book.

One of the features of the present embodiment is that this embodiment has a setting mechanism used to set the book in a state suitable for turning over pages so that the scanning of the moving body 1 forming the above-described turning-over mechanism for turning-over pages may be obtained using a relatively simple movement (i.e., horizontal scanning) without hindrance.

In view of the fact that the thicknesses of books are usually not constant and depending on the page to be read, it is difficult to know what the thicknesses of the left and right groups of sheets of a book when opened will be. This feature brings a book of any thickness having any number of pages turned-over into a state suitable for the operation of the page turning-over mechanism (that is, a flat state in which the upper surfaces of the left and right groups of sheets of the opened book are generally on one surface so that horizontal scanning of the moving body 1 can be effected). Also, by doing so, the left and right pages at which the book has been opened become generally flat, as one surface, and the ease with which the book is read is improved.

The construction of this setting mechanism in the present embodiment comprises a combination of three mechanisms, i.e., a downwardly moving mechanism for downwardly moving the moving base plate 11 as a whole, a seesaw type upwardly and downwardly moving mechanism for upwardly and downwardly moving the left and right groups of sheets of the opened book in vertically opposite directions, and an operation control mechanism for effecting the operations of the downwardly moving mechanism and the seesaw type upwardly and downwardly moving mechanism in a predetermined timing relation.

The downwardly moving mechanism will first be described. In the embodiment shown in FIG. 1, a pair of guide shafts 48 and 49 spaced apart from each other in the axial direction of the movement rail 14 are provided upright on the bed 80, and cylindrical guide shaft receivers 50 and 51 extending downwardly from the underside of the moving base plate 11 are fitted to the guide shafts 48 and 49, respectively. Moving base plate 11 is provided for vertical movement relative to the bed 80, and is vertically movable using the vertically extending rack plates 52 and 53 secured to the underside of the moving base plate 11, pinions 54 and 55 studded on the bed 80 and meshing with rack plates 52 and 53, and motors 56 and 57 for rotating the pinions 54 and 55 in accordance with a signal from a control device, not shown.

The upwardly moving mechanism of the moving base plate 11 comprising the pair of pinion-rack mechanisms and motors 56 and 57, in the present embodiment, can maintain the parallel (horizontal) state of the moving base plate 11 relative to bed 80 by making the number of teeth, the angles of rotation, the number of rotations and the direction of rotation of the two gears completely identical.

Description will now be made of the seesaw type upwardly and downwardly moving mechanism for moving left and right support beds 82 and 83, supporting the left and right groups of sheets of the opened book, in vertically opposite directions.

Figure 5:
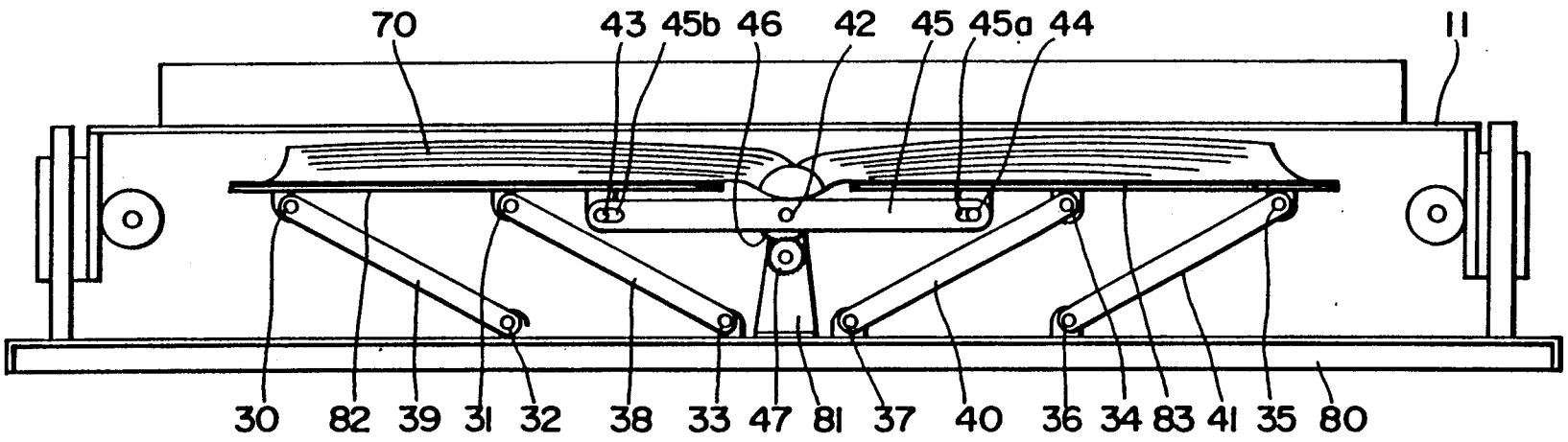
FIG. 5 is a front view showing support beds according to the present invention for supporting the left and right groups of sheets of an opened book.

The seesaw type upwardly and downwardly moving mechanism, in the present embodiment, as shown in FIG. 5, is constructed as a combination of (1) a parallelogramatic link mechanism for maintaining the left support bed 82 and the right support bed 83 at a horizontal posture and guiding the upward and downward movement thereof, and (2) a seesaw mechanism for transmitting the upward movement of one support bed (e.g. the left support bed 82) as the downward movement of the other support bed (e.g. the right support bed 83). That is, the left support bed 82 and the right support bed 83 are supported by the bed 80 through pivots 30, 31, 32, 33, 34, 35, 36 and 37 and parallel links 38, 39, 40 and 41 and are designed so as to be capable of always maintaining their parallel (horizontal) posture relative to bed 80.

An upwardly protruded fulcrum stand 81 is fixedly provided between the left and right support beds 82 and 83 on the bed 80, and a seesaw link 45 is pivotally supported on the upper portion of the fulcrum stand 81 through a pivot shaft 42 for rotation in the plane of the drawing sheet of FIG. 5. Opposite pivotable ends of the seesaw link 45 are connected to pivots 43 and 44 of the left and right support beds 82 and 83, through slots **45*a* and 45*b*** with a degree of play determined by the variation in the length of engagement during pivotal movement.

A gear 46 mounted on pivot shaft 42 forms the center of rotation of the seesaw link 45, and a gear 47 rotated by a reversible motor **47*a* (FIG. 3) is in meshing engagement with gear 46. By the rotation of motor 472, the seesaw link 45 is rotated in a clockwise direction or a counter-clockwise direction as viewed in FIG. 5. Accordingly, with the rotation of the seesaw link 45, one of the left and right support beds 82 and 83** moves upwardly and the other moves downwardly, that is, the left and right support beds move in vertically opposite directions.

Description will now be made of an operation control mechanism for controlling the downwardly moving mechanism for moving the moving base plate 11 and the seesaw type upwardly and downwardly moving mechanism for moving the pair of left and right support beds 82 and 83 in vertically opposite directions.

Figure 6:
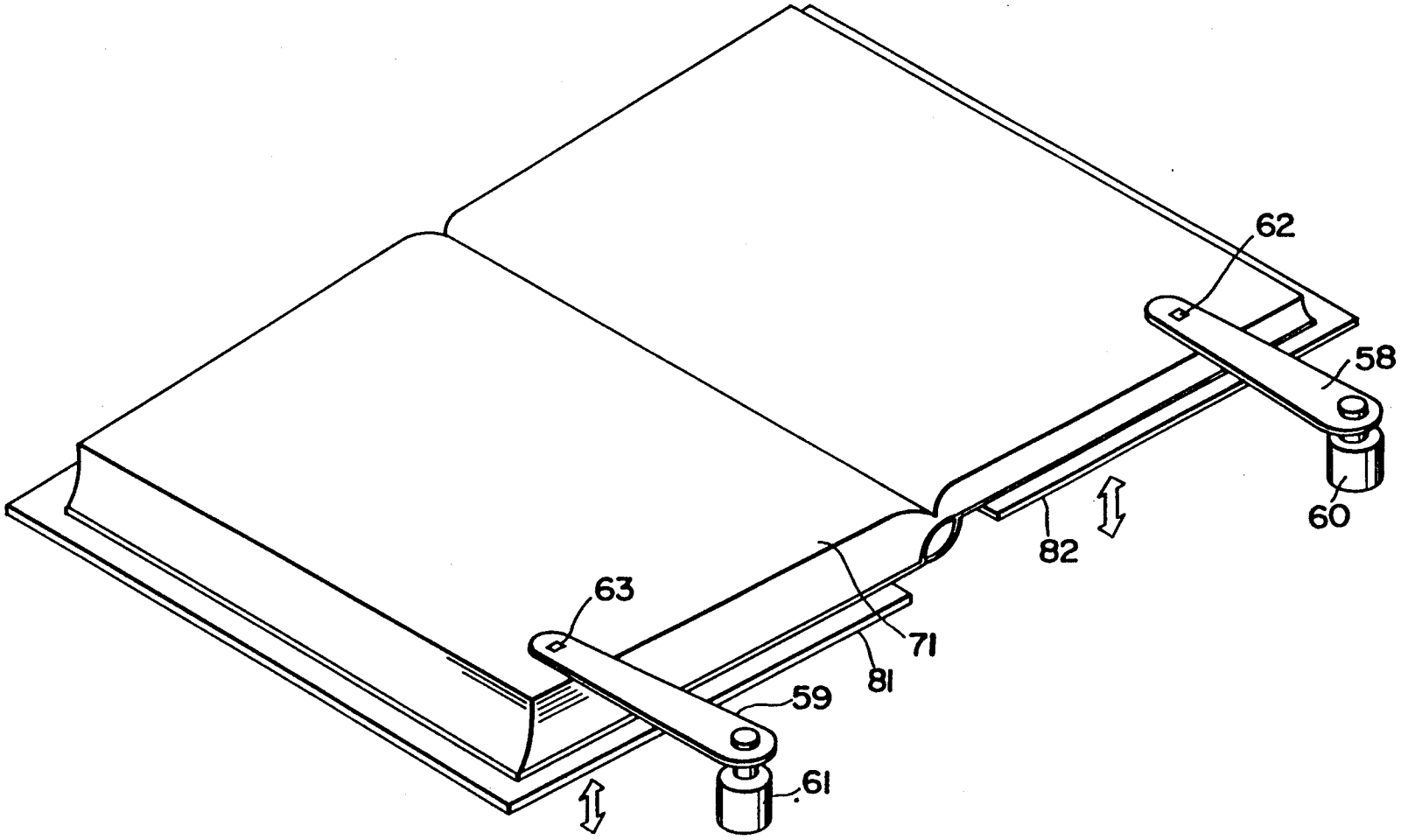
FIG. 6 is a perspective view showing sensors for the control of the support beds.

The operation control mechanism in the present embodiment has a pair of left and right pressure-sensitive sensors 62 and 63 mounted on the moving base plate 11 shown in FIG. 6.

The pressure-sensitive sensors 62 and 63 are attached to the fore ends of detecting plates 58 and 59 provided on the moving base plate 11 for rotation about the vertical axes thereof, and these detecting plates are rotatable by motors 60 and 61 During downward movement of the moving base plate 11 they cause the pressure-sensitive sensors 62 and 63 to be opposed to the upper surfaces of the left and right groups of sheets of the opened book therebelow, and detect contact therebetween when the gap between the pressure-sensitive sensors and said upper surfaces has become substantially null by the operation of the upwardly and downwardly moving mechanism. Detection signals from the pressure-sensitive sensors are utilized as stop signals for each respective operating mechanism.

That is, in the present embodiment, when both of said pressure-sensitive sensors 62 and 63 are in their non-detecting state, the downwardly moving mechanism for moving base plate 11 is operated, and when only one of said pressure-sensitive sensors is in its detecting state, downward movement of said downwardly moving mechanism is continued and rotation of the seesaw link of said seesaw type upwardly and downwardly moving mechanism is started.

Subsequently, the downwardly moving mechanism and the seesaw type upwardly and downwardly moving mechanism are further operated. The operation of these mechanisms is stopped when both of the pressure-sensitive sensors enter their detecting state.

The pressure-sensitive sensors 62 and 63 are necessary when setting an opened book on the apparatus, but becomes unnecessary thereafter. Therefore, they may preferably be retracted to a suitable retracted position by the rotation of the motors 60 and 61 so as not to hinder the scanning of the turning-over mechanism.

Figure 7:
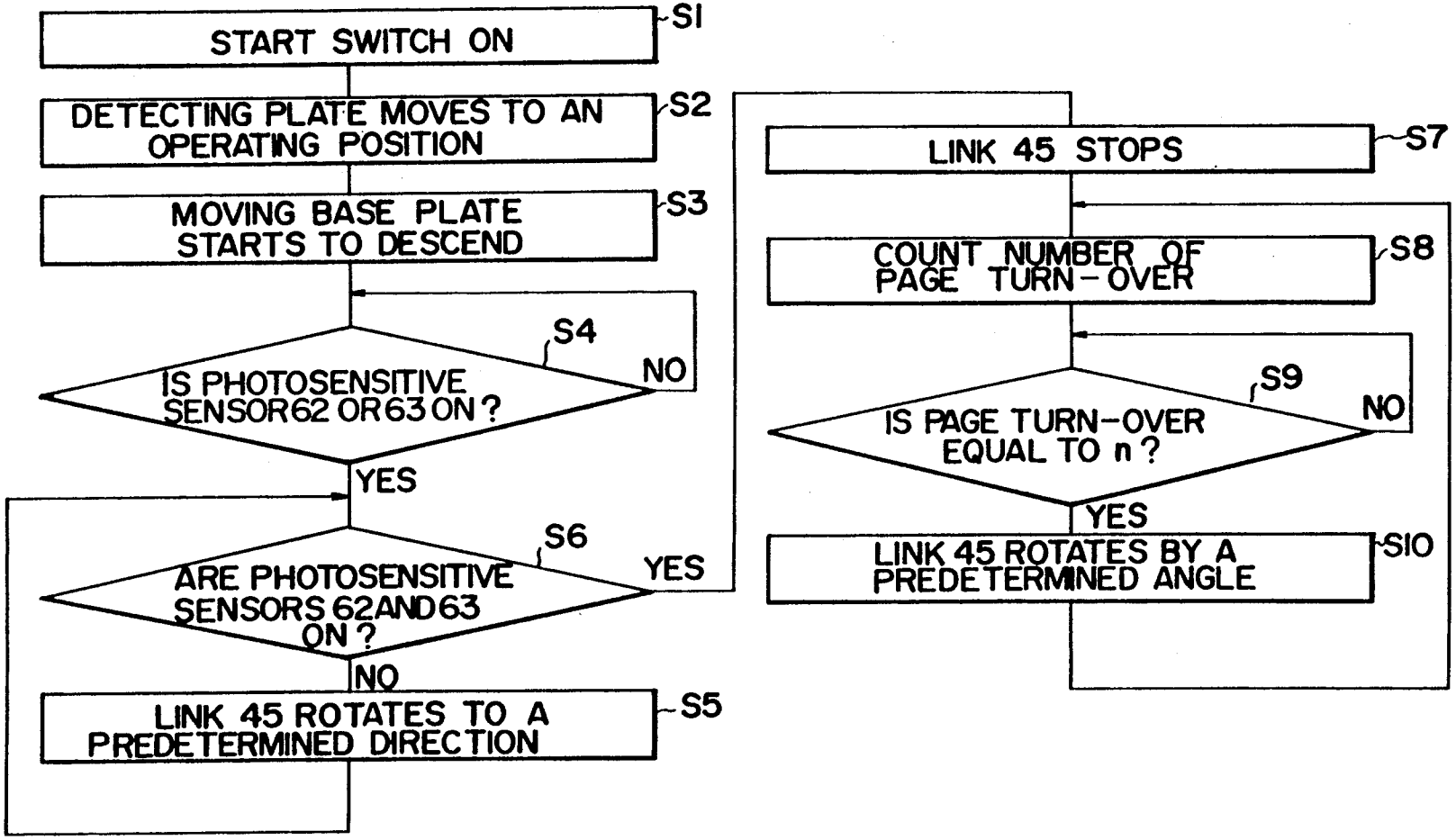
FIG. 7 is a control flow chart of the support beds.

The operation for coping with the thicknesses of books in the automatic page turning-over apparatus, constructed as described above, will now be described with reference to the block diagram of FIG. 3 and the flow chart of FIG. 7.

First, the left and right support beds 82 and 83 are brought into a horizontal state as shown in FIG. 5, and then an opened book is placed on these left and right support beds 82 and 83 (at this time, the link is locked against free rotation). In this state, the opened book 70 placed on the left and right support beds 82 and 83 is sufficiently spaced apart from moving base plate 11.

At step S1, the start switch 101 is depressed, the driving of motors 60 and 61 is controlled by control circuit 102 at step S2, and detecting plates 58 and 59 advance to the pressure detection operating position shown in FIG. 6. At step S3, the motors 56 and 57 for operating the downwardly moving mechanism to downwardly move moving base plate 11 are started.

By starting of operation of the motors 56 and 57, the entire moving base plate 11 including the pressure-sensitive sensors 62 and 63 progressively descends relative to the book 70 placed on the left and right support beds 82 and 83 in its stationary state.

At step S4, only one of the pressure-sensitive sensors 62 and 63 has turned ON, gear 47 is rotated by motor 47*a* at step S5 to rotate the link 45 in a direction so as to downwardly move the support bed corresponding to the pressure-sensitive sensor which has turned ON.

If at step S6, it is judged that both of the pressure-sensitive sensors 62 and 63 have turned ON, motor 47*a* is stopped at step S7 to stop link 45.

Figure 8A:
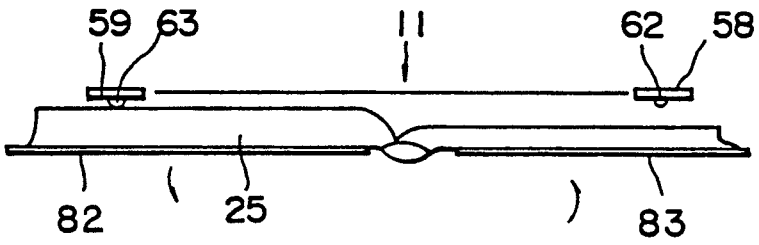
FIGS. 8A and 8B illustrate the operation of the support beds.

When the left group of sheets 71 is thicker, as shown, for example, in FIG. 8A, the left pressure-sensitive sensor 63 contacts the upper surface of the left group of sheets. At this time, in the present embodiment, rotation of link 45 is started. With downward movement of the moving base plate 11, rotation of the link 45 takes place, and the left support bed 82 supporting the group of sheets contacting the left pressure-sensitive sensor 63 follows the downward movement of moving base plate 11 and the right support bed 83 is moved upwardly.

Figure 8B:
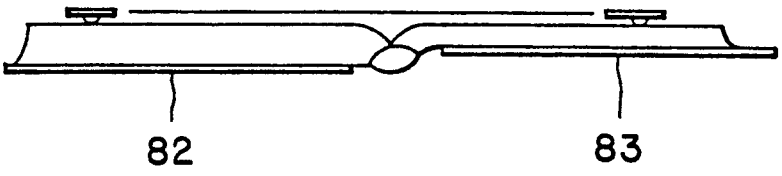

As a result, the upper surface of the right group of sheets placed on the right support bed 83 is progressively moved upward and comes into contact with the right pressure-sensitive sensor 62 (FIG. 8B) By this pressure detection, the driving of motors 56 and 57 for downwardly moving the moving base plate 11 and motor 47*a* for rotating the link 45 is stopped and, further, the retraction of the detecting plates 58 and 59 to their retracted position is effected.

Thus, a state is reached in which the upper surfaces of the left and right groups of sheets of the opened book placed on the left and right support beds become one surface (flat), which is suitable for scanning by the moving body 1 in the automatic page turning-over described in connection with FIG. 1.

Description will now be made of a correcting mechanism one of the features of the present embodiment of the present invention which corrects any difference in thickness between of the left and right groups of sheets, resulting from the automatic page turning-over operation.

The thickness correcting mechanism in the present embodiment includes an upwardly and downwardly moving mechanism to which are operatively connected the left and right support beds 82 and 83.

That is, as described above, for example, in connection with FIG. 2, when the uppermost sheet of the left group of sheets is turned over onto the right group of sheets in succession, the thickness of the left group of sheets becomes gradually smaller and, correspondingly, the thickness of the right group of sheets becomes greater. Accordingly, if this is left as it is, there will occur a level difference between the upper surfaces of the left and right groups of sheets, which in turn will hinder the scanning of moving body 1.

So, in the present invention, the number of movements of the moving body 1 (the number of page turnover) is counted by a counter in the control circuit (step S8), and when this count has reached a predetermined value n (step S9), motor 47*a* is rotated by a predetermined angle at step S10 to thereby rotate link 45 by an amount corresponding, for example, to one tooth of the gears 46 and 47 so that the support bed supporting the group of sheets which becomes thicker (in the above-described example, the right support bed 83) is moved downward. At this time, in the present embodiment, the support bed supporting the group of sheets which becomes thinner (in the above-described example, the left support bed 82) is moved upward.

The rotative driving of motor 472 for such thickness correction may be effected several times in association, for example, with the number of page turning-over operations, or minute rotation may be effected each time. In short, the upward and downward movements of the left and right support beds 82 and 83 in vertically opposite directions may be effected so that the heights of the upper surfaces of the left and right groups of sheets may be maintained generally flush with each other to such a degree that the above-described scanning for page turn-over by moving body 1 is not hindered.

The counter for counting the number of such page turning-over operations and motor drive means for rotating the link 45 in conformity with the count value by this counter may also be constructed by using known circuit techniques, for example, a comparator or a timer.

Of course, the correcting mechanism for correcting any variation in the thickness of the left and right group of sheets may be constructed with the above-described setting mechanism for the opened book and, in addition, may be constructed entirely discretely therefrom.

Figure 9:
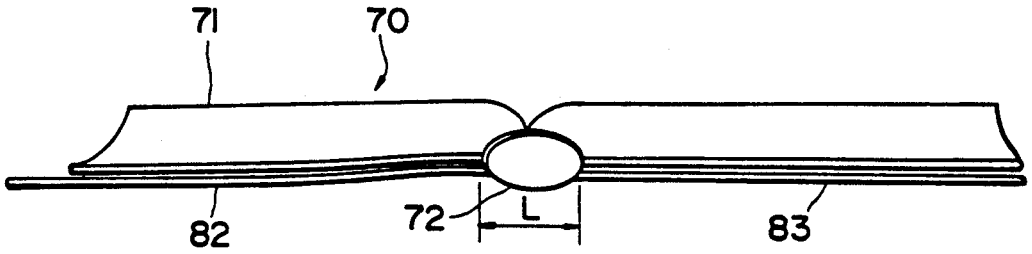
FIG. 9 shows a second embodiment of the present invention.

FIG. 9 shows a second embodiment of the present invention in which the gap L between the left and right support beds 82 and 83 is set to at least 10 mm when they are most proximate to each other. By doing so, portion 72 of a thick book falls into this gap to thereby provide a suitable opened state for the book.

Figure 10:
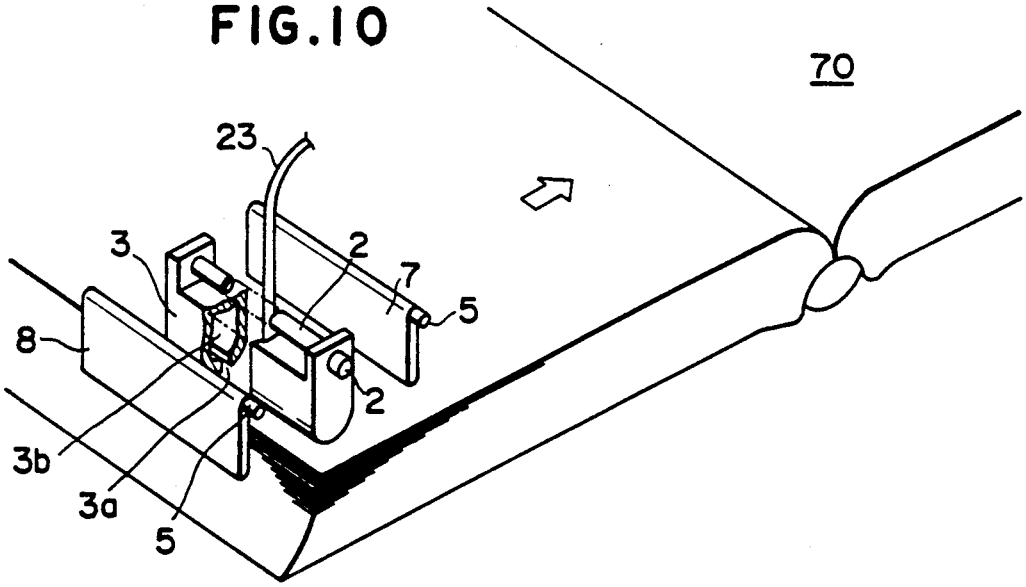
FIG. 10 shows a third embodiment of the present invention.

Description will now be made of a third embodiment of the present invention in which an absorbing body 3 of the shape shown in FIG. 10 is used in place of the absorbing body 3 shown in the first embodiment. In FIG. 10, absorbing body 3 is a hollow body having a substantially rectangular cross-section and a rounded underside. Reference character 3*a* designates an absorption port comprising a groove-like hole or a plurality of holes provided in the lower arcuate surface of the absorbing body 3*a*. The absorption port 3 is connected to the hollow 3*b* of the absorbing body 3.

Description will now be made of a fourth embodiment of the present invention in which a rotary body 3 having an engagement surface with a high coefficient of friction is used in place of the absorbing body 3 in the above-described embodiments.

Figure 11:
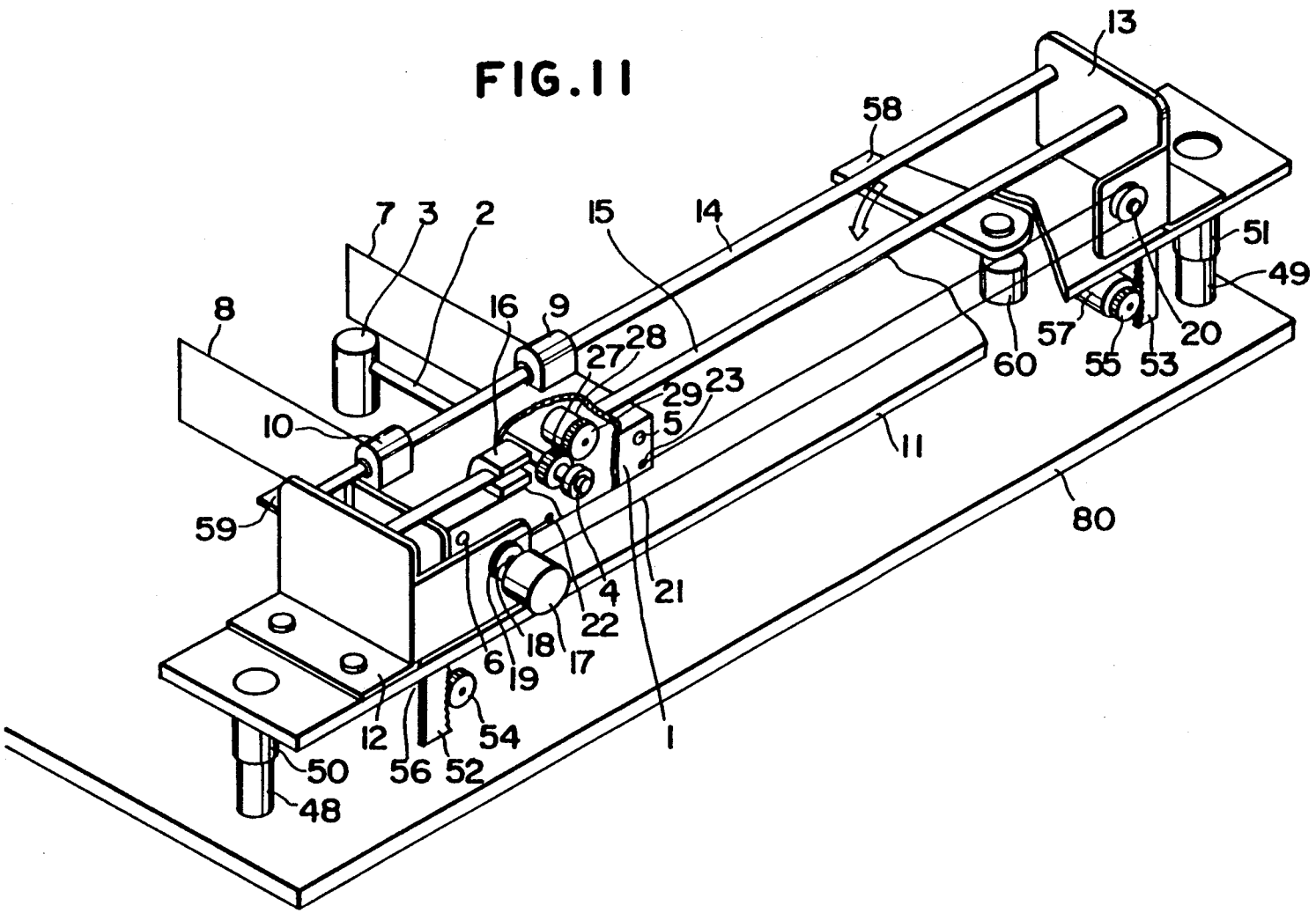

Referring to FIG. 11, a rotary shaft 2 protrudes from a moving body 1 in a direction orthogonal thereto in a horizontal plane. Movement of said rotary shaft 2 is provided for rotation about the axis thereof extending in the direction of protrusion (rotation in the direction indicated by an arrow in FIG. 11), The rotary body 3 has a page-engaging surface at the vertically lower end thereof and is assembled to the end of the rotary shaft 2 in such a manner so as to assume a vertical posture. The page-engaging surface of rotary body 3 may preferably be formed as a surface with a high coefficient of friction so as to be suitable for turning over pages. The reference numeral 4 designates a bearing for supporting the rotation of the rotary shaft about the axis thereof.

In FIG. 11, the other members are identical in construction to those in FIG. 1 and therefore are give reference numerals similar to those in FIG. 1 and need not be described.

In the present embodiment, the bed on which a book is placed is the same as that shown in FIG. 5 and the operation thereof is the same as the operation of the first embodiment described in connection with FIGS. 6 and 7.

The operation of the page turning-over mechanism in the fourth embodiment will now be described with reference to FIGS. 12A, 12B, 12C and 12D and FIGS. 13 and 14.

Figure 12A:
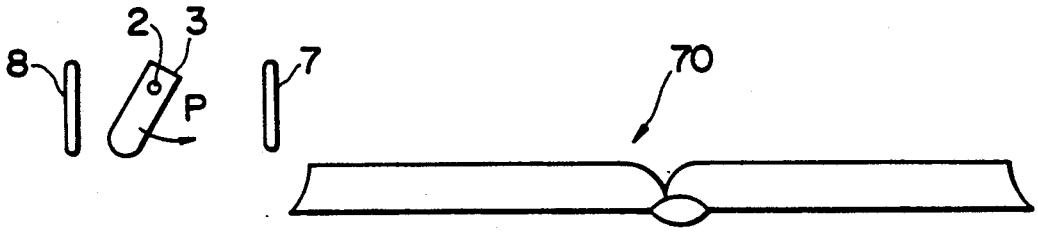
FIGS. 12A, 12B, 12C and 12D illustrate the operation thereof.
Figure 12B:
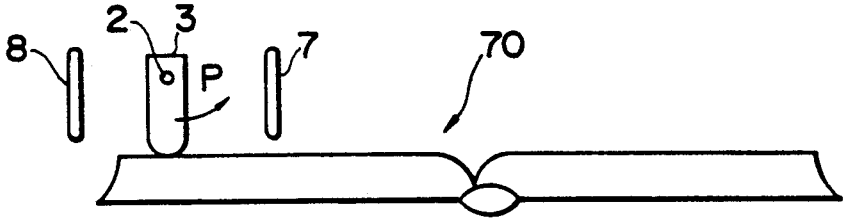
Figure 13:
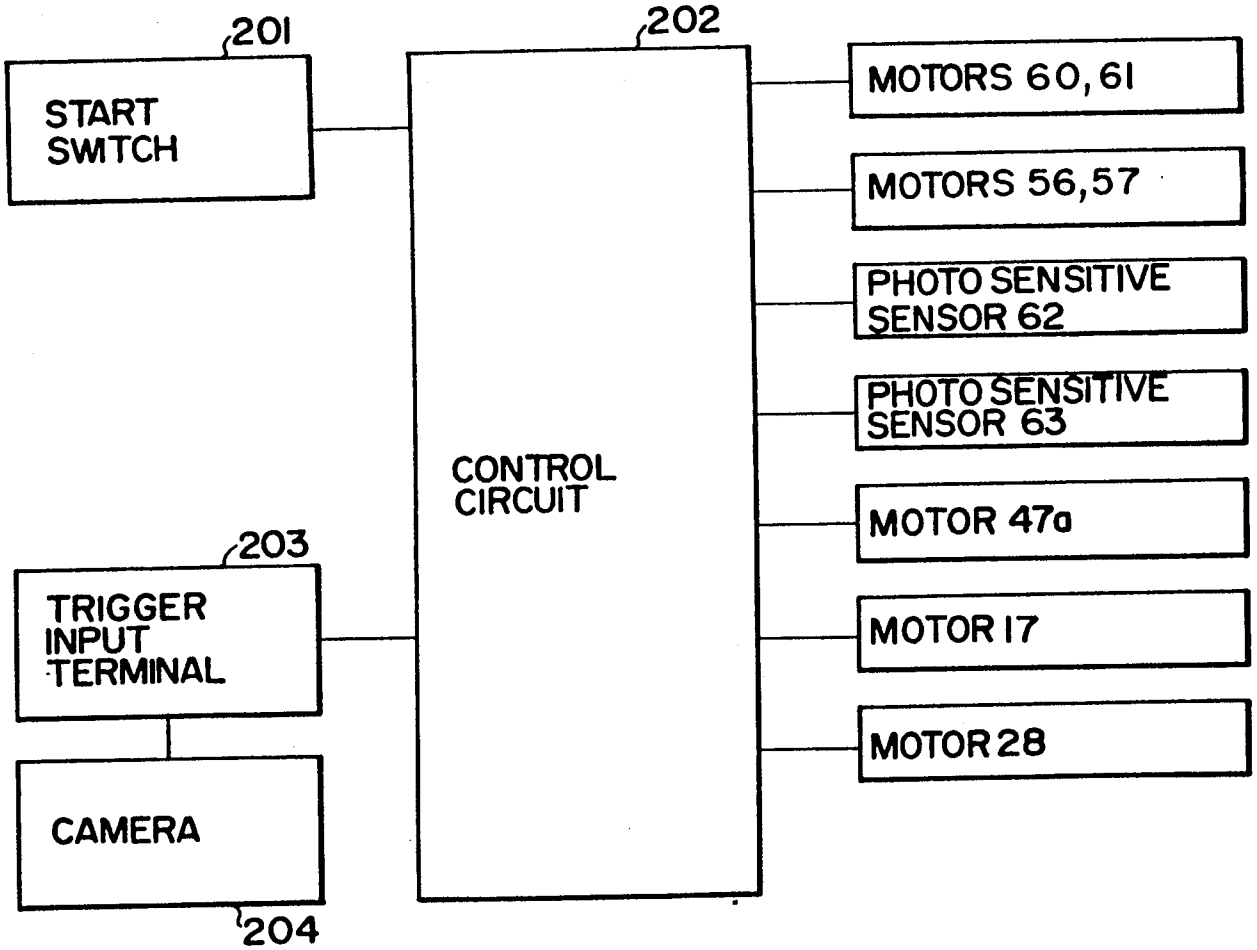
FIG. 13 is a block diagram thereof.
Figure 14:
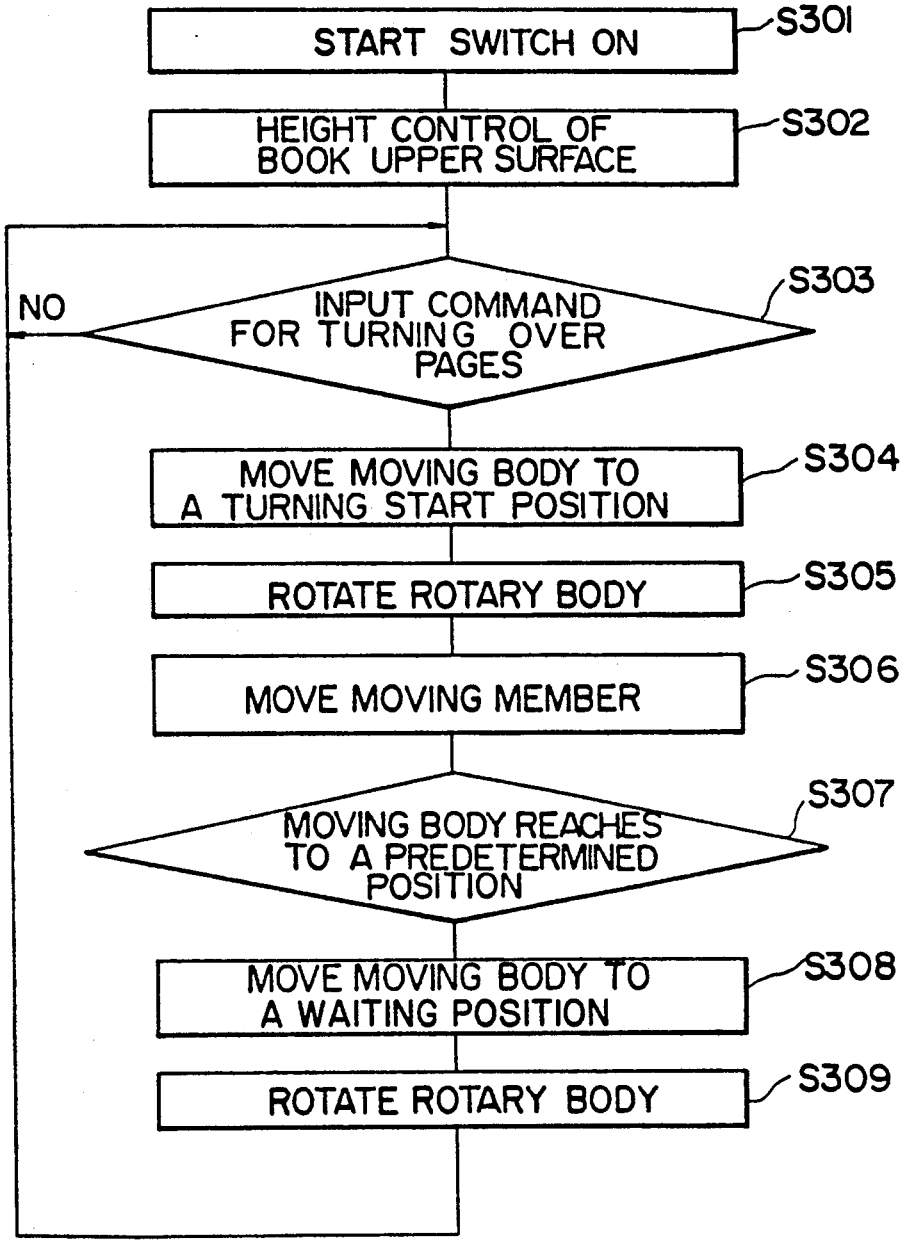
FIG. 14 is a flow chart thereof.

In FIG. 13, the reference numeral 202 designates a control circuit for controlling the operation of the automatic page turning-over apparatus, and the reference numeral 201 denotes the start switch of the automatic page turning-over apparatus. When as shown in FIG. 5, an opened book is placed on the support beds 82 and 83 and the start switch 201 is closed, the control circuit 202 effects control in accordance with the flow chart of FIG. 7 so that the upper surfaces of the left and right groups of sheets are substantially horizontal as previously described (steps S301 and S302). The reference numeral 203 designates a trigger input terminal for inputting a page turn-over command to the control circuit. Where a camera is operatively associated with the page turn-over, the command signal is produced from the camera. Alternatively, the command signal may be produced by a mere switch. When at step S303, it is judged that the page turn-over signal has been input, the motor 17 is controlled so that the moving body 1 which has so far waited in the standby position shown in FIG. 12A is moved to the turn-over starting position shown in FIG. 12B (step S304). The rotary body 3 is inclined by a predetermined angle, as shown in FIG. 12A, so that during its movement the rotary body 3 does not rub the sheet.

Figure 12C:
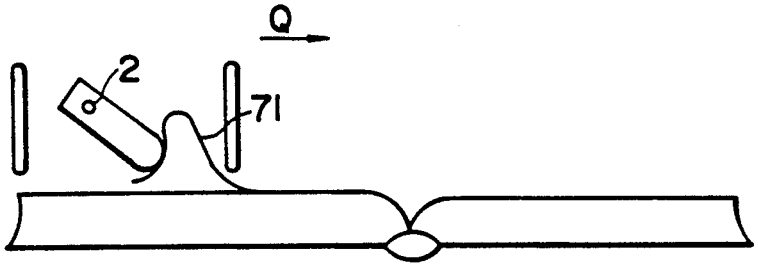

Subsequently, at step S305, the motor 28 is rotated to bring the rotary body 3 into engagement with the uppermost sheet 71 of the left group in sheets of the book as shown in FIG. 12B. Rotary body 3 is then sharply rotated by about 90°, and by the presence of the paper applying plates 7 and 8, the uppermost sheet is caused to float up as shown in FIG. 12C and rest on the rotary body 3 (FIG. 12D).

Then, at step S306, motor 17 is rotated to move the rotary body 3 onto the right group of sheets, thereby accomplishing the page turn-over.

Figure 12D:
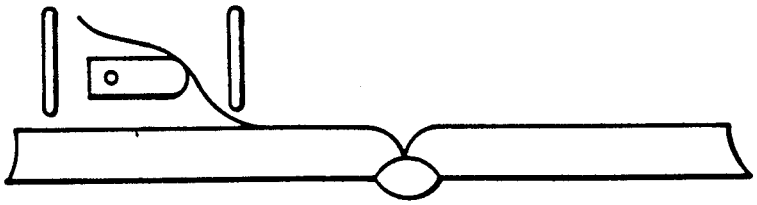

At step S307, the moving body 1 (and accordingly the rotary body 3) is moved to a predetermined position on the right group of sheets to turn over a page, whereafter motor 17 is rotated in the reverse direction to return the rotary body 3 to its standby position as it faces sideways (step S308), and as the preparation for the next page turn-over, at step S309, the rotary body is rotated to the angular position of FIG. 12D by motor 28, whereby the rotary body 3 is caused to stand by.

The above-described page turning-over operation has been explained with respect to the operation from the left side to the right side, and is quite similar to the operation in the opposite direction.

Depending on the quality in paper of the book, the necessary engaging force of the rotary body 3 with respect to the uppermost sheet 71 differs. A design may preferably be made such that this can be variably controlled by regulating of the position in the upward direction. Where, for example, the paper is thick, operation may be effected with said engaging force increased, and where the paper is thin, operation may be effected with said engaging force decreased.

We claim:

1. A supporting bed comprising:

a first holding means for holding a first group of sheet originals on one side with respect to a seam of a book-like original comprising a bundle of bound sheet originals when said book-like original is opened;

second holding means for holding a second group of sheet originals on a side opposite to said first group of sheet originals with respect to said seam;

sensor means for detecting the height of said first group of sheet originals and said second group of sheet originals; and position control means for controlling the position of at least one of said first holding means and said second holding means in response to the height detection by said sensor means so that an uppermost sheet original of said first group of sheet originals and an uppermost sheet original of said second group of sheet originals are positioned substantially on the same plane.

2. A supporting bed according to claim 1, wherein said first holding means includes a first bed for supporting said first group of sheet originals thereon, and said second holding means includes a second bed for supporting said second group of sheet originals thereon.

3. A supporting bed according to claim 1, wherein said sensor means comprises a pair of sensors, one of which is for detecting the height of said first group of sheet originals and the other of which is for detecting the height of said second group of sheet originals.

4. A supporting bed according to claim 1, wherein said position control means includes a pivotable member having one end thereof connected to at least one holding means.

5. A supporting bed according to claim 4, further comprising drive means for pivoting said pivotable member.

6. A supporting bed according to claim 5, wherein said pivotable member has one end thereof connected to said first holding means and the other end thereof connected to said second holding means.

7. An automatic page turning-over apparatus comprising:

spacing means for spacing an uppermost sheet original of a book-like original having a bundle of bound sheet originals apart from a remainder of said bundle of sheet originals under said uppermost sheet original;

a moving member adapted to move under said uppermost sheet original spaced apart by said spacing means and invert said uppermost sheet original onto an opposite side with respect to said remainder of said bundle of sheet originals;

support means for supporting said spacing means and said moving member; and moving means for moving said support means to thereby move said spacing means and said moving member;

sensor means for detecting the height of inverted sheet originals and said remainder of said bundle of sheet originals; and a level adjusting device for adjusting and equalizing the height of said inverted sheet originals and said remainder of said bundle of sheet originals.

8. An automatic page turning-over apparatus according to claim 7, wherein said sensor means comprises a pair of sensors, one of which is for detecting the height of said inverted original sheets and the other of which is for detecting the height of said remainder of said bundle of sheet originals.

9. An automatic page turning-over apparatus according to claim 7, wherein said spacing means comprises suction means for applying suction to the uppermost sheet original.

10. An automatic page turning-over apparatus according to claim 7, wherein said spacing means comprises a friction member contacting the uppermost sheet original for applying a frictional force thereto.

11. An automatic page turning-over apparatus according to claim 10, wherein said friction means rotates while contacting the uppermost sheet original.

12. An automatic page turning-over apparatus comprising:

first holding means for holding a first group of sheet originals on one side with respect to a seam of a book-like original having a bundle of bound sheet originals when said book-like original is opened;

second holding means for holding a second group of sheet originals on a side opposite to said first group of sheet originals with respect to said seam;

sensor means for detecting the height of said first group of sheet originals and said second group of sheet originals;

position control means for controlling the position of at least one of said first holding means and said second holding means in response to the height detection by said sensor means so that an uppermost sheet original of said first group of sheet originals and an uppermost sheet original of said second group of sheet originals are positioned substantially on the same plane;

spacing means for spacing said uppermost sheet original of said first group of sheet originals apart from a remainder of said bundle of sheet originals under said uppermost sheet original;

a moving member adapted to move under said uppermost sheet original spaced apart from said remainder of said bundle of sheet originals by said spacing means and turning said spaced apart uppermost sheet original onto an opposite side with respect to said seam of said book-like original;

support means for supporting said spacing means and said moving member; and moving means for moving said support means to thereby move said spacing means and said moving member.

13. An automatic page turning-over apparatus according to claim 12, wherein said sensor means comprises a pair of sensors, one of which is for detecting the height of said first group of sheet originals and the other of which is for detecting the height of said second group of sheet originals.

* * * * *

UNITED STATES PATENT AND TRADEMARK OFFICE

CERTIFICATE OF CORRECTION

PATENT NO. : 5,247,755

DATED : September 18, 1993

INVENTOR(S) : TADASHI SATO, et al.

It is certified that error appears in the above-identified patent and that said Letters Patent is hereby corrected as shown below:

COVER PAGE

At [57], line 5, "wherein," should read --wherein--; line 8, "for supporting" should read --supports--.

COLUMN 2

Line 22, "in" should be deleted.

COLUMN 3

Line 19, "hear" should read --bear--.

COLUMN 6

Line 2, "lelogramatic" should read --lelogrammatic--.
Line 51, "61" should read --61.--

COLUMN 7

Line 10, "becomes" should read --become--.

COLUMN 10

Line 22, "in paper of" should read --of paper in--.

Signed and Sealed this

Thirty-first Day of May, 1994

Bruce Lehman

*Attest:*

BRUCE LEHMAN

*Attesting Officer*

*Commissioner of Patents and Trademarks*